US007588042B2

(12) United States Patent
Chang

(10) Patent No.: US 7,588,042 B2
(45) Date of Patent: Sep. 15, 2009

(54) FOLDING SHAFT FOR UMBRELLAS

(75) Inventor: Dragon Chang, Hsinchu (TW)

(73) Assignee: Golden Rain Enterprise Co., Ltd., Guangdong Province (CN)

( * ) Notice: Subject to any disclaimer, the term of this patent is extended or adjusted under 35 U.S.C. 154(b) by 0 days.

(21) Appl. No.: 11/826,221

(22) Filed: Jul. 13, 2007

(65) Prior Publication Data

US 2008/0149153 A1 Jun. 26, 2008

(30) Foreign Application Priority Data

Dec. 21, 2006 (CN) ..... 2006 1 0157833

(51) Int. Cl.
*A45B 19/04* (2006.01)

(52) U.S. Cl. ..... 135/25.1; 135/25.4; 403/377; 403/109.1

(58) Field of Classification Search ..... 135/16, 135/25.1, 25.3, 25.31, 25.4, 114, 75; 403/109.1–109.8, 403/377; 248/188.5, 418, 219.1; D25/122; 280/819, 820, 823
See application file for complete search history.

(56) References Cited

U.S. PATENT DOCUMENTS 2,949,692 A * 8/1960 Kuhn ..... 446/69
4,687,012 A * 8/1987 Schultes et al. ..... 135/75
5,458,427 A * 10/1995 Simond ..... 403/109.5
5,720,311 A * 2/1998 Lin et al. ..... 135/25.1
5,791,359 A * 8/1998 Lin et al. ..... 135/24
5,803,102 A * 9/1998 Ko ..... 135/24
6,035,873 A * 3/2000 Lin et al. ..... 135/25.1
6,112,755 A * 9/2000 Lin et al. ..... 135/24
6,338,353 B1 * 1/2002 Chen ..... 135/20.3
6,343,568 B1 * 2/2002 McClasky ..... 119/428
6,418,949 B1 * 7/2002 Lin et al. ..... 135/25.1
D466,280 S * 12/2002 Ko ..... D3/3
6,854,916 B2 * 2/2005 Hsieh ..... 403/109.3
D503,035 S * 3/2005 Ko ..... D3/5
D512,215 S * 12/2005 Ko ..... D3/10

* cited by examiner

*Primary Examiner*—Winnie Yip
(74) *Attorney, Agent, or Firm*—Rosenberg, Klein & Lee

(57) ABSTRACT

A folding shaft for umbrellas includes a first section having a circular cross section and the first section is retractably received in a second section which includes an enclosed cross section which includes a plurality of straight sides and a plurality of first curved portions connected between the straight sides. A third section is movably mounted to the second section and including an enclosed cross section which includes a plurality of inward curved sides and a plurality of second curved portions connected between the inward curved sides. The inward curved sides of the third section are located corresponding to the straight sides of the second section. The second curved portions of the third section are located corresponding to the first curved portions. The gap between these sections can be controlled to be the minimum.

5 Claims, 9 Drawing Sheets

FOLDING SHAFT FOR UMBRELLAS

FIELD OF THE INVENTION

The present invention relates to a folding shaft for umbrellas and the sections of the shaft includes polygonal shape sections and circular shape sections which are be alternatively connected to the sections of polygonal shape.

BACKGROUND OF THE INVENTION

A conventional folding shaft of an umbrella generally includes three or four sections which are retractably connected to each other in a sequence such that when the umbrella is not in use, the shaft can be folded to be a short shaft. The foldable shaft is cooperated with an opening device which includes a spring arranged to be extended through the sections of the shaft. In order to smoothly extend or fold the shaft, the inner diameter of each section has to be controlled so as to ensure smooth operation while the opening device can be installed therein. However, a gap is defined between the sections and affects the operation of the folding shaft. Conventional folding shaft of umbrellas generally includes sections each have a circular cross section and the friction between the sections is significant. If the gaps between the circular sections are made large to reduce the friction and accommodate the spring of the opening device, the spring might not be installed in stable condition.

The present invention intends to provide a folding shaft for umbrellas and the sections of the folding shaft includes sections with polygonal shape and sections with circular section, the sections with polygonal shape and sections with circular section are retractably connected to each other in an alternative sequence so as to obtain minimum gap between sections.

SUMMARY OF THE INVENTION

The present invention relates to a folding shaft for umbrellas and the shaft comprises a first section having a circular cross section, a second section movably mounted to the first section and a third section movably mounted to the second section. The second section includes an enclosed cross section which includes a plurality of straight sides and a plurality of first curved portions connected between the straight sides. The third section includes an enclosed cross section which includes a plurality of inward curved sides and a plurality of second curved portions connected between the inward curved sides, and the inward curved sides of the third section are located corresponding to the straight sides of the second section. The second curved portions of the third section are located corresponding to the first curved portions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
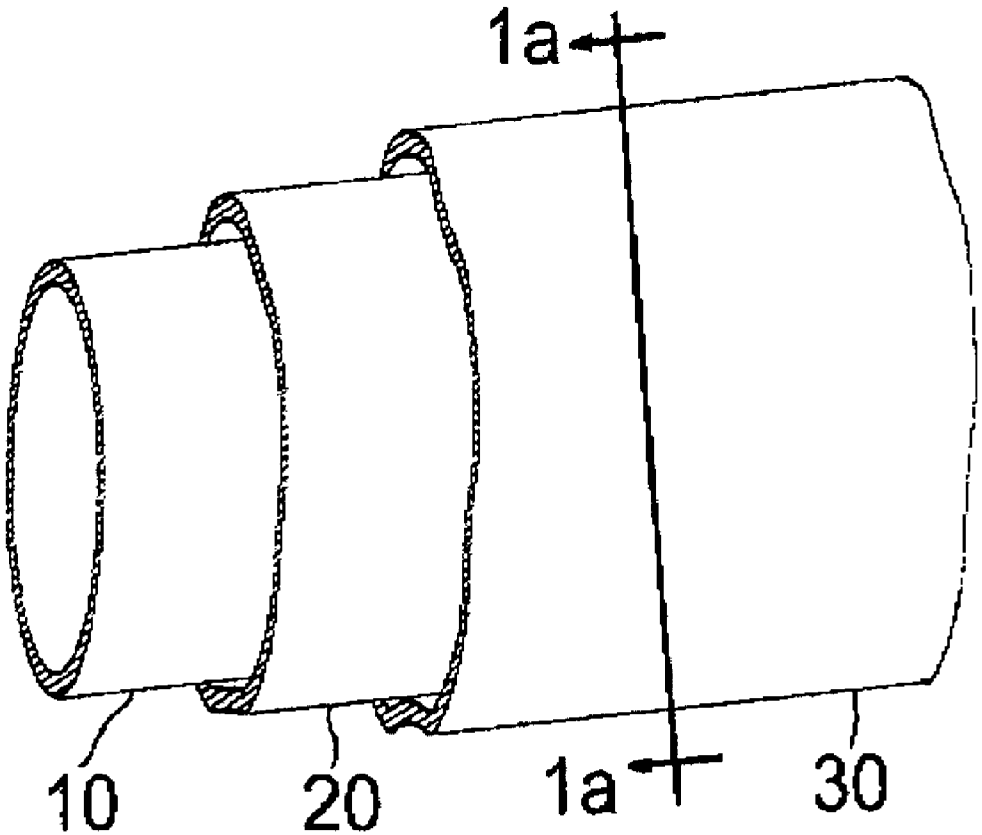
FIG. 1 shows the three sections of the first embodiment of the folding shaft are assembled.
Figure 1A:
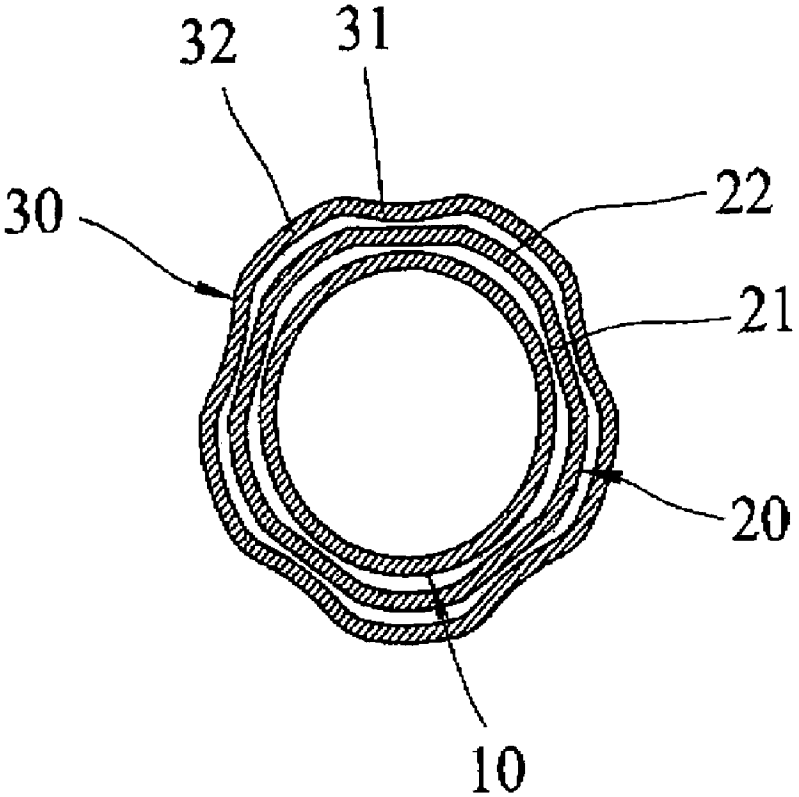
FIG. 1*a* shows a cross section of the three sections in FIG. 1.
Figure 2C:
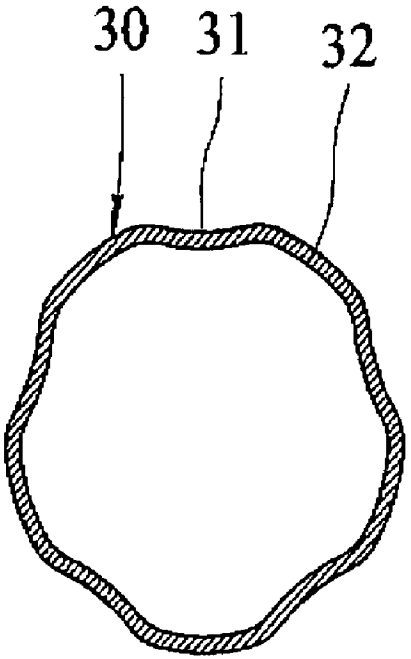
FIG. 2*c* shows the cross section of the external section in FIG. 1.
Figure 2B:
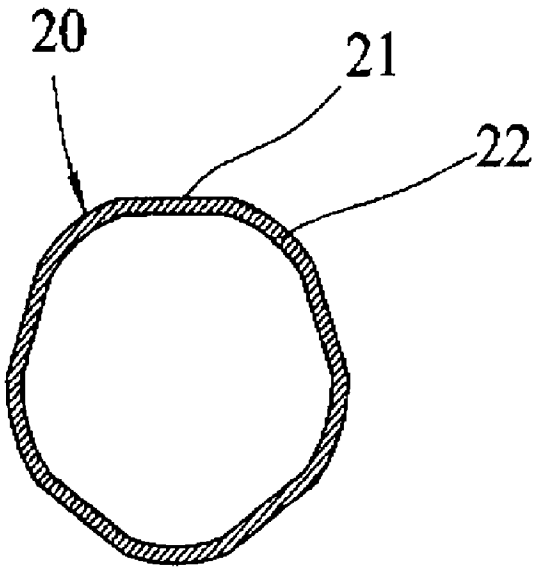
FIG. 2*b* shows the cross section of the intermediate section in FIG. 1.
Figure 2A:
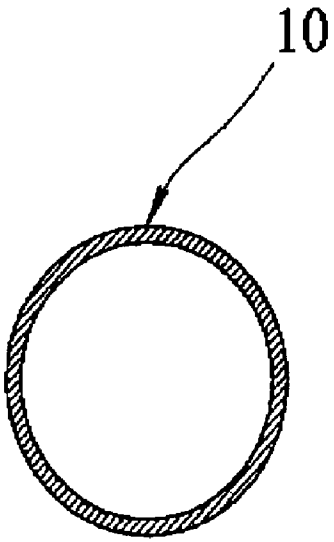
FIG. 2*a* shows the cross section of the central section in FIG. 1.
Figure 3:
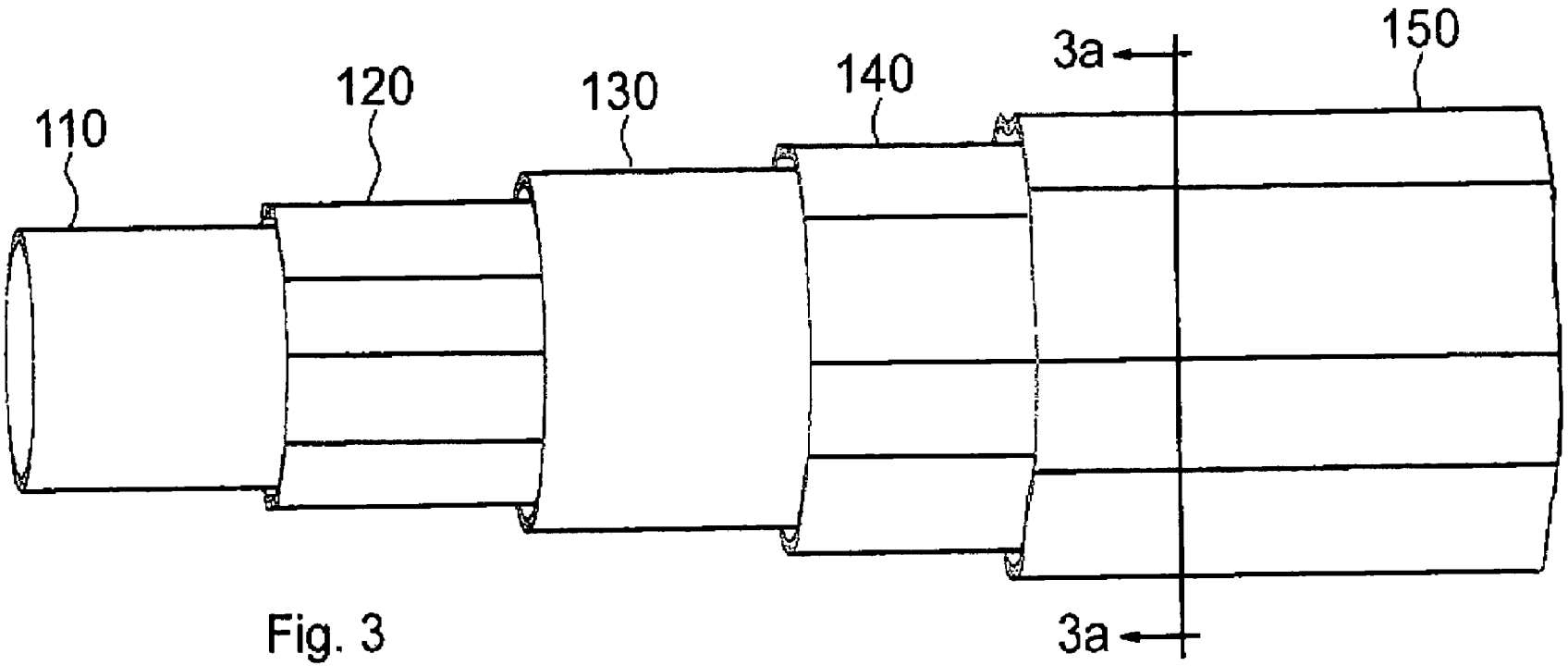
FIG. 3 shows the five sections of the second embodiment of the folding shaft are assembled.
Figure 3A:
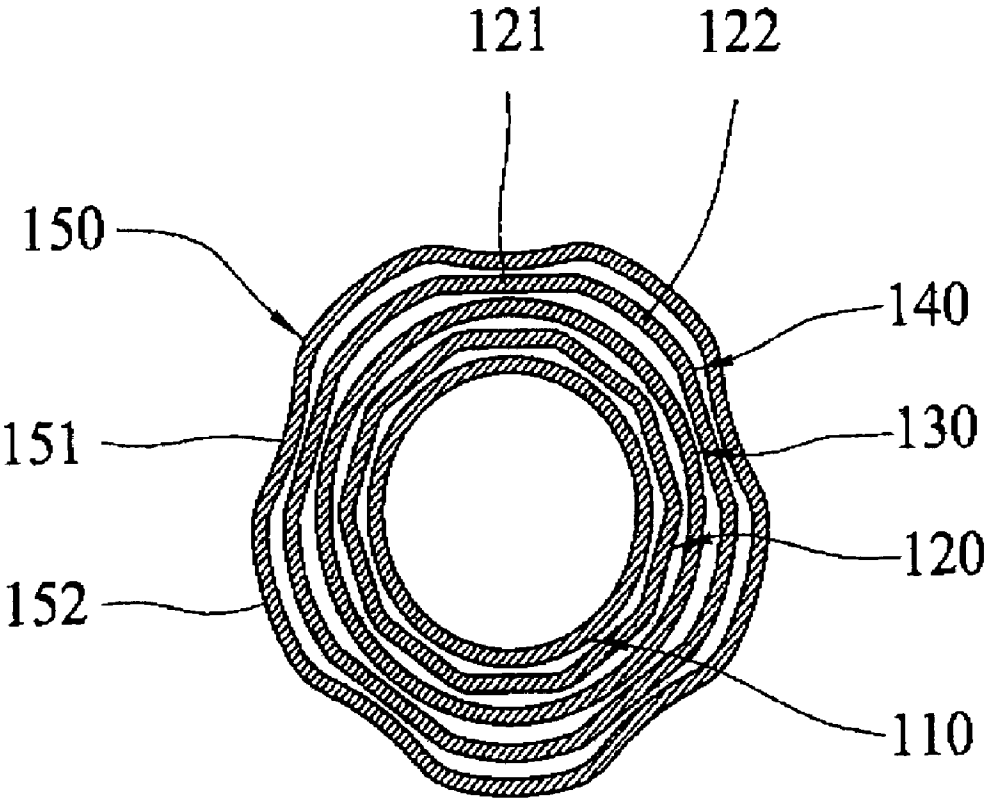
FIG. 3*a* shows a cross section of the five sections in FIG. 3.
Figures 4A, 4B, 4C, 4D, 4E:
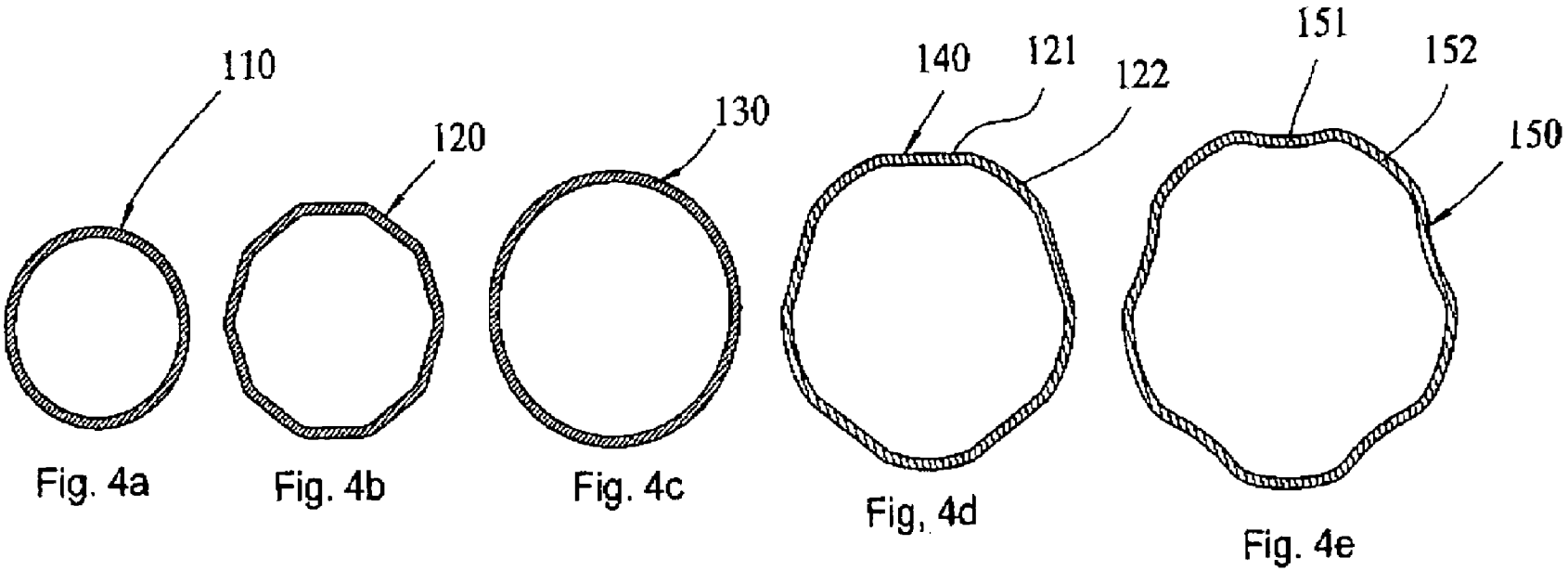
FIG. 4*a* shows the cross section of the central section in FIG. 3.
FIG. 4*b* shows the cross section of the first intermediate section in FIG. 3.
FIG. 4*c* shows the cross section of the second intermediate section in FIG. 3.
FIG. 4*d* shows the cross section of the third intermediate section in FIG. 3.
FIG. 4*e* shows the cross section of the external section in FIG. 3.

Referring to FIGS. 1, 1*a*, and 2*a*-2*c*, the first embodiment of the folding shaft of the present invention comprises a first section 10 having a circular cross section, a second section 20 movably mounted to the first section 10 and including an enclosed cross section which includes a plurality of straight sides 21 and a plurality of first curved portions 22 connected between the straight sides 21, and a third section 30 movably mounted to the second section 20 and including an enclosed cross section which includes a plurality of inward curved sides 31 and a plurality of second curved portions 32 connected between the inward curved sides 31. The inward curved sides 31 of the third section 30 are located corresponding to the straight sides 21 of the second section 20, and the second curved portions 32 of the third section 30 are located corresponding to the first curved portions 22. Preferably, the depth of each of the inward curved sides 31 is 1/10 to 1/5 of the length of the side. In this embodiment, the second section 20 includes five straight sides 21 and five first curved portions 22, and the third section 30 includes five inward curved sides 31 and five second curved portions 32.

FIGS. 3, 3*a* and 4*a*-4*e* show a second embodiment of the folding shaft of the present invention wherein five sections are involved and includes a first section 110 having a circular cross section, a second section 120 movably mounted to the first section 110 and including an enclosed cross section which includes a plurality of first straight sides and a plurality of first curved portions connected between the first straight sides. A third section 130 is movably mounted to the second section 120 and has a circular cross section. A fourth section 140 is movably mounted to the third section 130 and includes an enclosed cross section which includes a plurality of second straight sides 121 and a plurality of second curved portions 122 connected between the second straight sides 121. The second straight sides 121 of the fourth section 140 are located corresponding to the first straight sides of the second section 120, and the second curved portions 122 of the fourth section 140 are located corresponding to the first curved portion of the second section 120. A fifth section 150 is movably mounted to the fourth section 140 and includes an enclosed cross section which includes a plurality of inward curved sides 131 and a plurality of third curved portions 132 connected between the inward curved sides 131. The inward curved sides 131 of the fifth section 150 are located corresponding to the second straight sides 121 of the fourth section 140, and the third curved portions 132 of the fifth section 150 are located corresponding to the second curved portions 122. Preferably, the second section 120 includes five first straight sides and five first curved portions, and the fourth section 140 includes five second straight sides 121 and five second curved portions 122. The fifth section 150 includes five inward sides 131 and five third curved portions 132.

Figure 5:
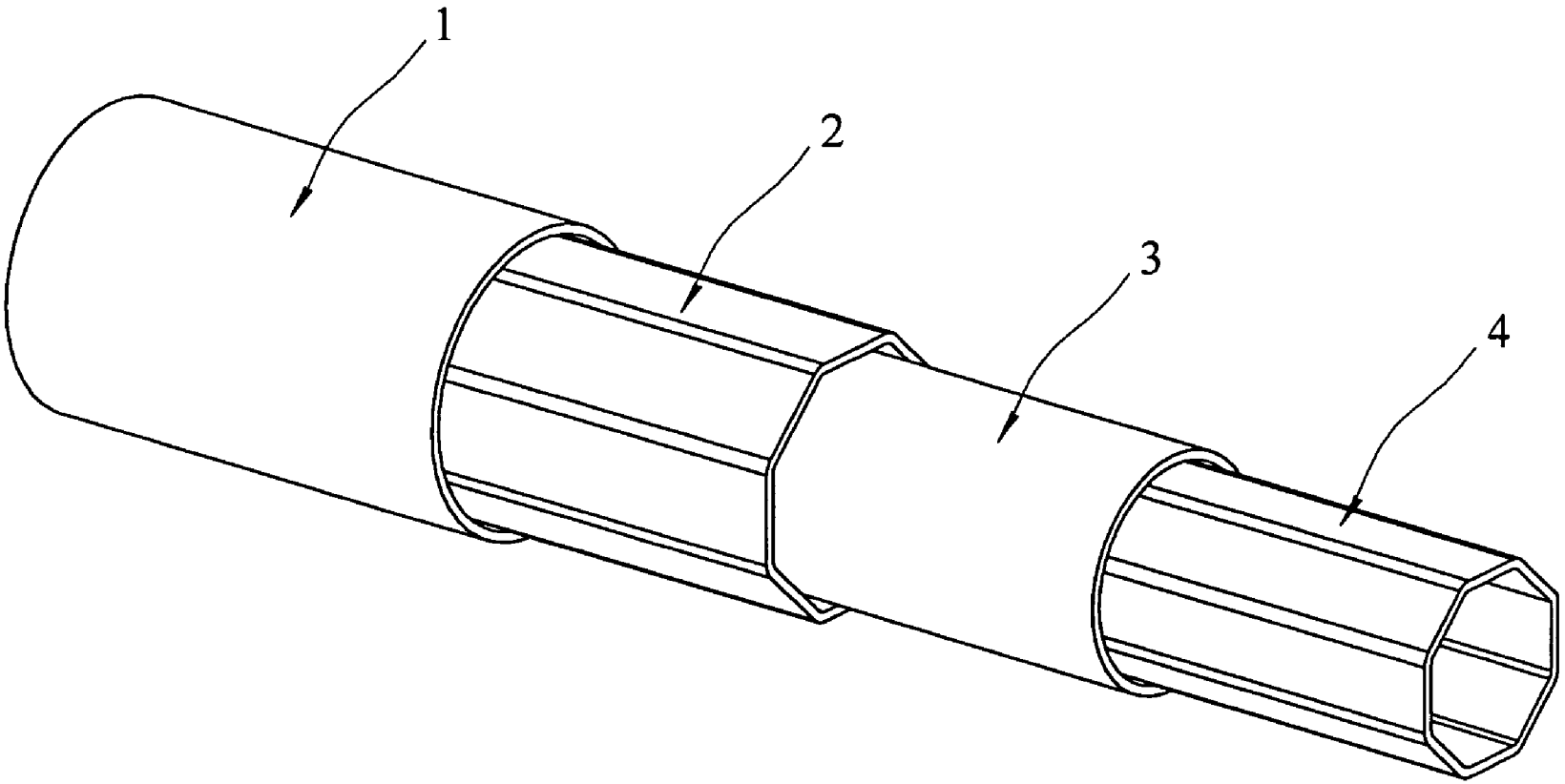
FIG. 5 shows four sections of the third embodiment of the folding shaft of the present invention are assembled together.
Figure 5A:
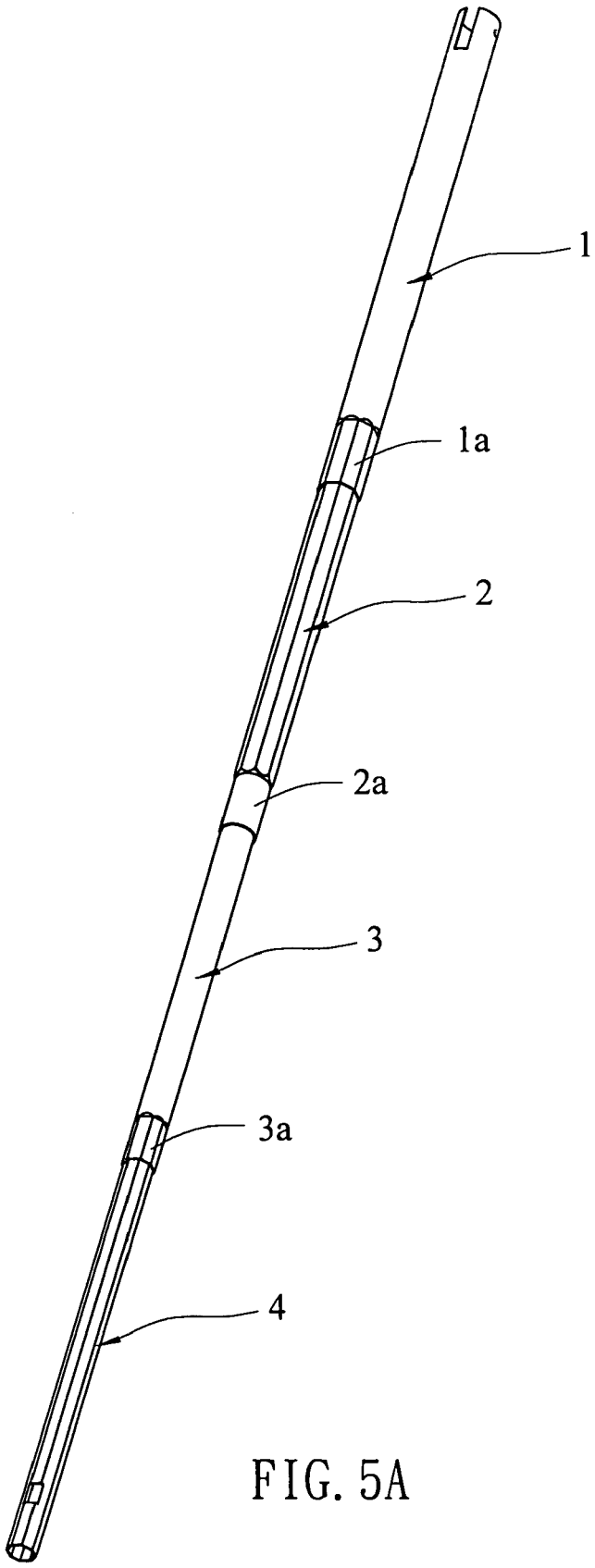
FIG. 5*a* shows the sections of the shaft are in extended status.
Figure 5B:
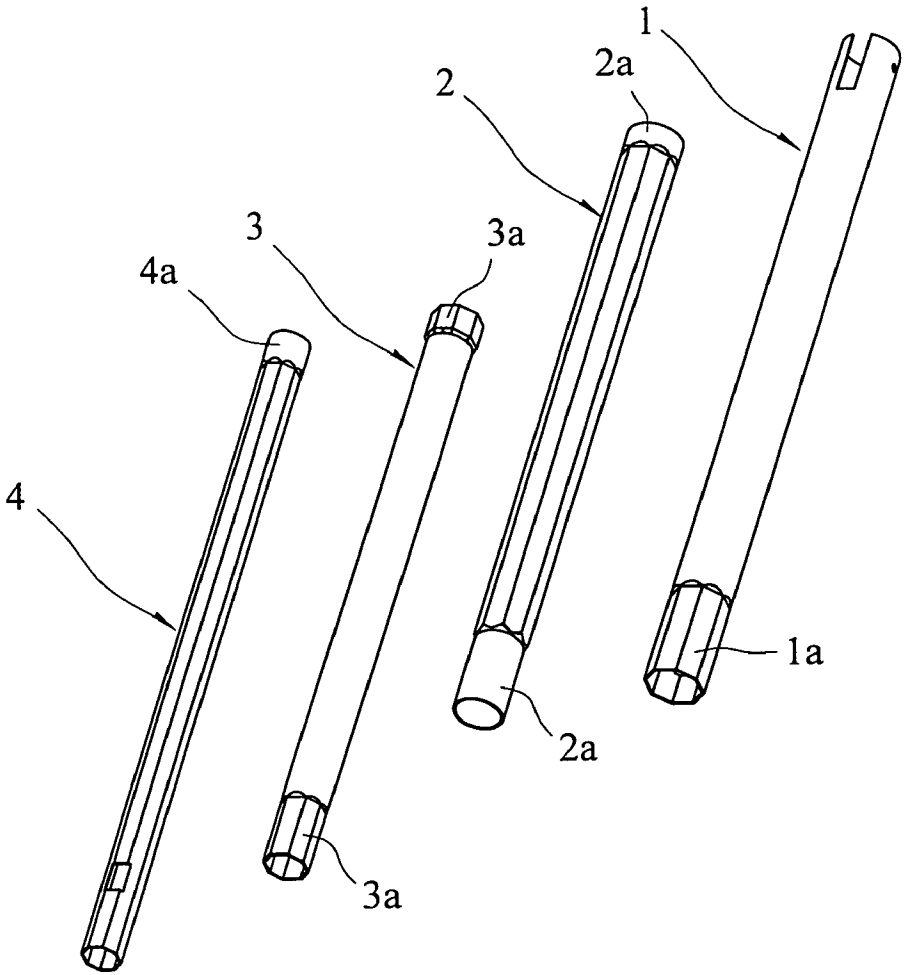
FIG. 5*b* shows the four sections of the third embodiment of the folding shaft of the present invention.

FIGS. 5, 5*a* and 5*b*, a third embodiment of the folding shaft of the present invention four sections wherein a first section 1 has a circular cross section and a polygonal section 1*a* extending from a first end thereof, a notch defined longitudinally in a second end of the first section 1. A second section 2 is retractably received in the first section 1 and includes an enclosed polygonal cross section. Two circular sections 2*a* are connected to two ends of the second section 2. A third section 3 is retractably received in the second section 2 and includes a circular cross section, two polygonal sections 3*a* connected on two ends of the third section 3. A fourth section 4 is retractably received in the third section 3 and includes an enclosed polygonal cross section. A circular section 4*a* is connected to a first end of the second section 2 and a second end of the second section 2 includes a longitudinal opening.

The gaps between the sections of the folding shaft is controlled to be the minimum so that the folding shaft can be made smaller, and the gaps also ensure that the spring can be well installed in the folding shaft to ensure the operation of the folding shaft.

While we have shown and described the embodiment in accordance with the present invention, it should be clear to those skilled in the art that further embodiments may be made without departing from the scope of the present invention.

What is claimed is:

1. A folding shaft for umbrellas, comprising:

a first section having a circular cross section;

a second section movably mounted to the first section and including an enclosed cross section which includes a plurality of straight sides and a plurality of first curved portions connected between the straight sides, said first section being telescopingly received within said second section, and a third section movably mounted to the second section and including an enclosed cross section which includes a plurality of inward curved sides each having an arcuate length and a plurality of second curved portions connected between the inward curved sides, the inward curved sides of the third section being located corresponding to the straight sides of the second section and said inward curved sides having a depth in a range between 0.1 and 0.2 of said length of each said inward caved sides, the second curved portions of the third section being located corresponding to the first curved portions, said second section being telescopingly received within said third section.

2. The shaft as claimed in claim 1, wherein the second section includes five straight sides and five first curved portions, the third section includes five inward curved sides and five second curved portions.

3. A folding shaft for umbrellas, comprising:

a first section having a circular cross section;

a continuously formed second section movably mounted to the first section and including an enclosed cross section which includes a plurality of first straight sides and a plurality of first curved portions connected between the first straight sides, said first section being telescopingly received within said second section;

a third section movably mounted to the second section and having a circular cross section said continuously formed second section being sandwiched between said third section and said first section, said second section being telescopingly received within said third section;

a continuously formed fourth section movably mounted to the third section and including an enclosed cross section which includes a plurality of second straight sides and a plurality of second curved portions connected between the second straight sides, the second straight sides of the fourth section being located corresponding to the first straight sides of the second section, the second curved portions of the fourth section being located corresponding to the first curved portion of the second section, said third section being telescopingly received within said fourth section, and a fifth section movably mounted to the fourth section and including an enclosed cross section which includes a plurality of inward curved sides and a plurality of third curved portions connected between the inward curved sides, the inward curved sides of the fifth section being located corresponding to the second straight sides of the fourth section, the third curved portions of the fifth section being located corresponding to the second curved portions, said fourth section being telescopingly received within said fifth section.

4. The shaft as claimed in claim 3, wherein the second section includes five first straight sides and five first curved portions, the fourth section includes five second straight sides and five second curved portions, the fifth section includes five inward sides and five third curved portions.

5. A folding shaft for umbrellas, comprising:

a first section having a circular cross section and a polygonal section extending from a first end thereof, a notch defined longitudinally in a second end of the first section;

a second section retractably received in the first section and including an enclosed polygonal cross section, two circular sections connected to two ends of the second section;

a third section retractably received in the second section and including a circular cross section, two polygonal sections connected on two ends of the third section, and a fourth section retractably received in the third section and including an enclosed polygonal cross section, a circular section connected to a first end of the fourth section and a second end of the fourth section including an opening.

* * * * *